United States Patent [19]

Rais et al.

[11] 4,186,917

[45] Feb. 5, 1980

[54] OPERATING TABLE FOR MEDICAL PURPOSES

[75] Inventors: Arnold Rais, Basel; André Lüssi, Ostermundigen, both of Switzerland

[73] Assignee: M. Schaerer A.G., Wabern, Switzerland

[21] Appl. No.: 830,220

[22] Filed: Sep. 2, 1977

[30] Foreign Application Priority Data

May 27, 1977 [CH] Switzerland ..... 6595/77

[51] Int. Cl.[2] ..... A61G 13/00

[52] U.S. Cl. ..... 269/325

[58] Field of Search ..... 269/322–326; 254/86 H

[56] References Cited

U.S. PATENT DOCUMENTS

| | | | |
|---|---|---|---|
| 1,957,151 | 5/1934 | Pollard | 254/86 H |
| 2,217,783 | 10/1940 | Bell | 269/325 |
| 2,619,319 | 11/1952 | Lucas | 254/86 H |
| 3,845,946 | 11/1974 | Warden et al. | 269/323 |

*Primary Examiner*—Robert C. Watson

*Attorney, Agent, or Firm*—Pearne, Gordon, Sessions

[57] ABSTRACT

An operating table having a plurality of hydraulic jacks for adjustment purposes is equipped with a pressure fluid reservoir containing sufficient fluid to supply the jacks for carrying out several hundred strokes so that the operating table may be left free of any electrical equipment and of pressure fluid hoses leading to the outside during use of the table.

2 Claims, 3 Drawing Figures

OPERATING TABLE FOR MEDICAL PURPOSES

This invention relates to an operating table for medical purposes, of the type having a plurality of mutually adjustable table parts including a foot and a plurality of rollers accommodated in the foot, a plurality of hydraulic working cylinders for adjusting the table parts with respect to one another, and control means for controlling the cylinders, the rollers being lowerable to enable displacement of the operating table.

It is an object of this invention to provide an improved operating table of the aforementioned type which is designed in such a way that while fully retaining its mobility and the operating capacity of its hydraulic working cylinders, it nevertheless has no electric or pneumatic motor for driving a pressure-oil pump while the operating table is in use, nor does it have any kind of supply lines which must be connected to an outside source of pressure oil or compressed air while it is in use. The absence of an electric motor is predicated on the need for complete freedom from creeping current during use of the operating table; the absence of supply lines is predicated on the need for complete mobility for the purpose of displacing the operating table within the operating room, so that free-lying or -hanging cables or hoses are naturally out of the question.

To this end, in the operating table according to the present invention, the improvement comprises a pressure fluid reservoir connected to the working cylinders via the control means for providing a sole pressure fluid source when the operating table is in use. This pressure fluid reservoir will obviously have to have sufficient capacity to enable several hundred working strokes to be carried out.

In a preferred embodiment, the operating table according to the present invention further comprises a charging unit accommodated in the foot and including an electric or pneumatic motor and a pump for charging the pressure fluid reservoir, and means for coupling the charging unit to an electric supply cable or to a compressed-air supply hose, as the case may be, the charging unit being designed to operate only when the operating table is not in use.

Figure 1:
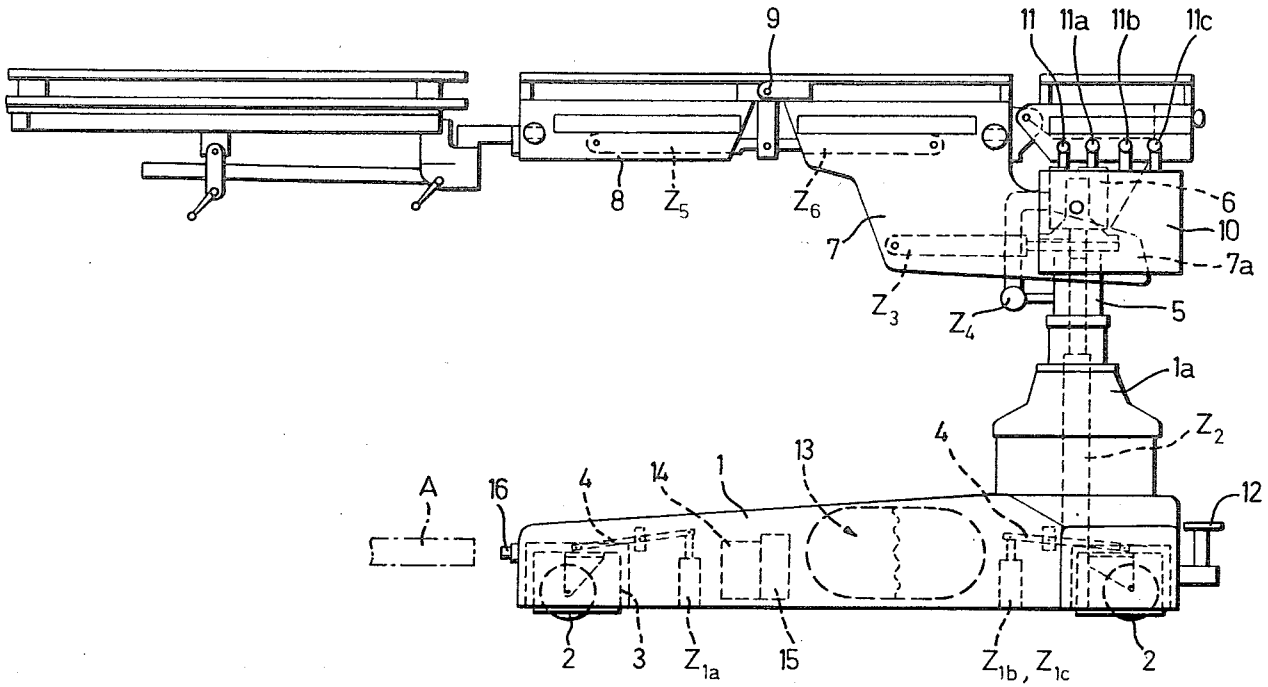

Such a preferred embodiment of the invention will now be described in detail with reference to the accompanying drawings, in which:

FIG. 1 is an elevation of the operating table, and

Figure 2A:
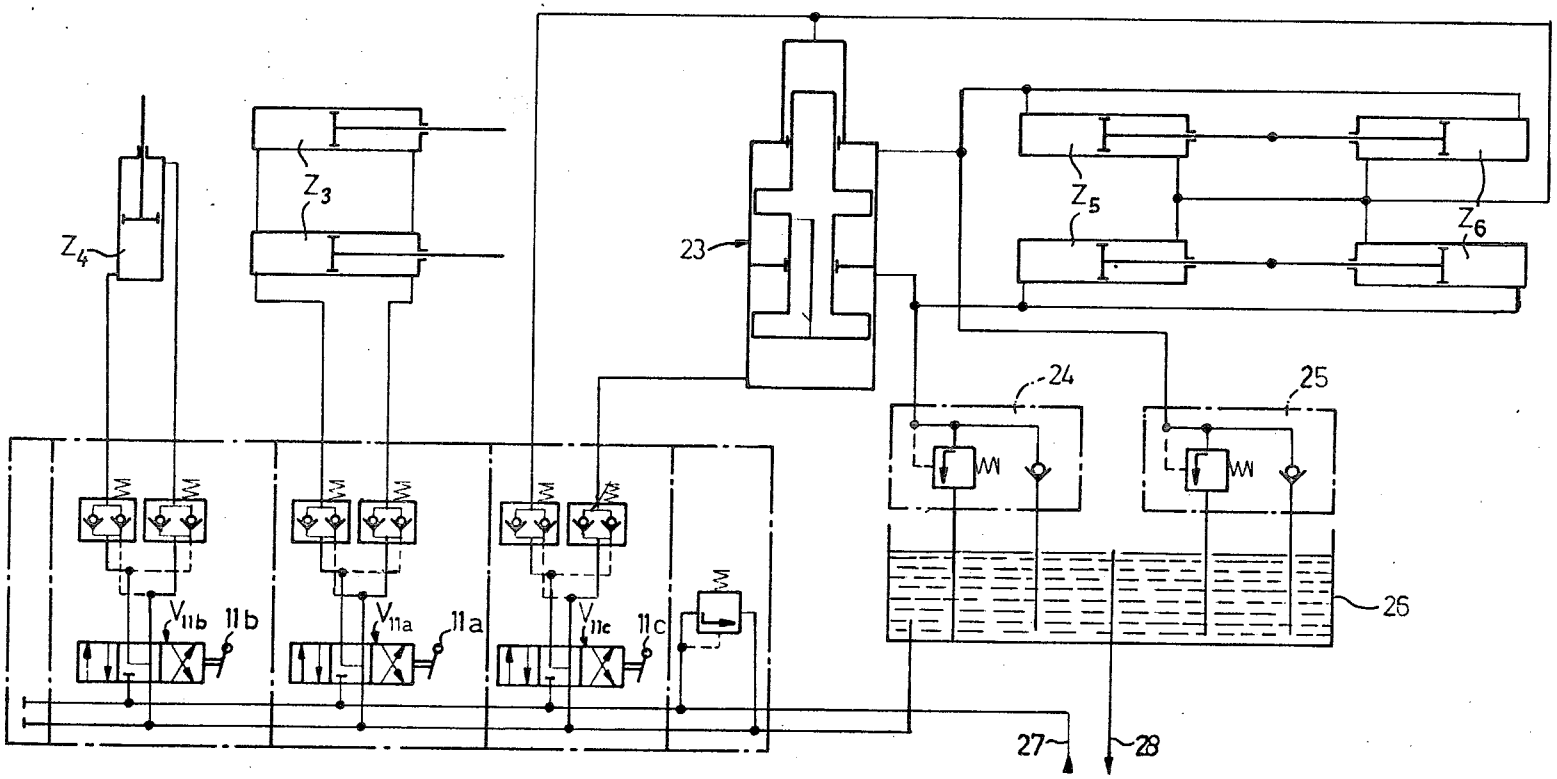
Figure 2B:
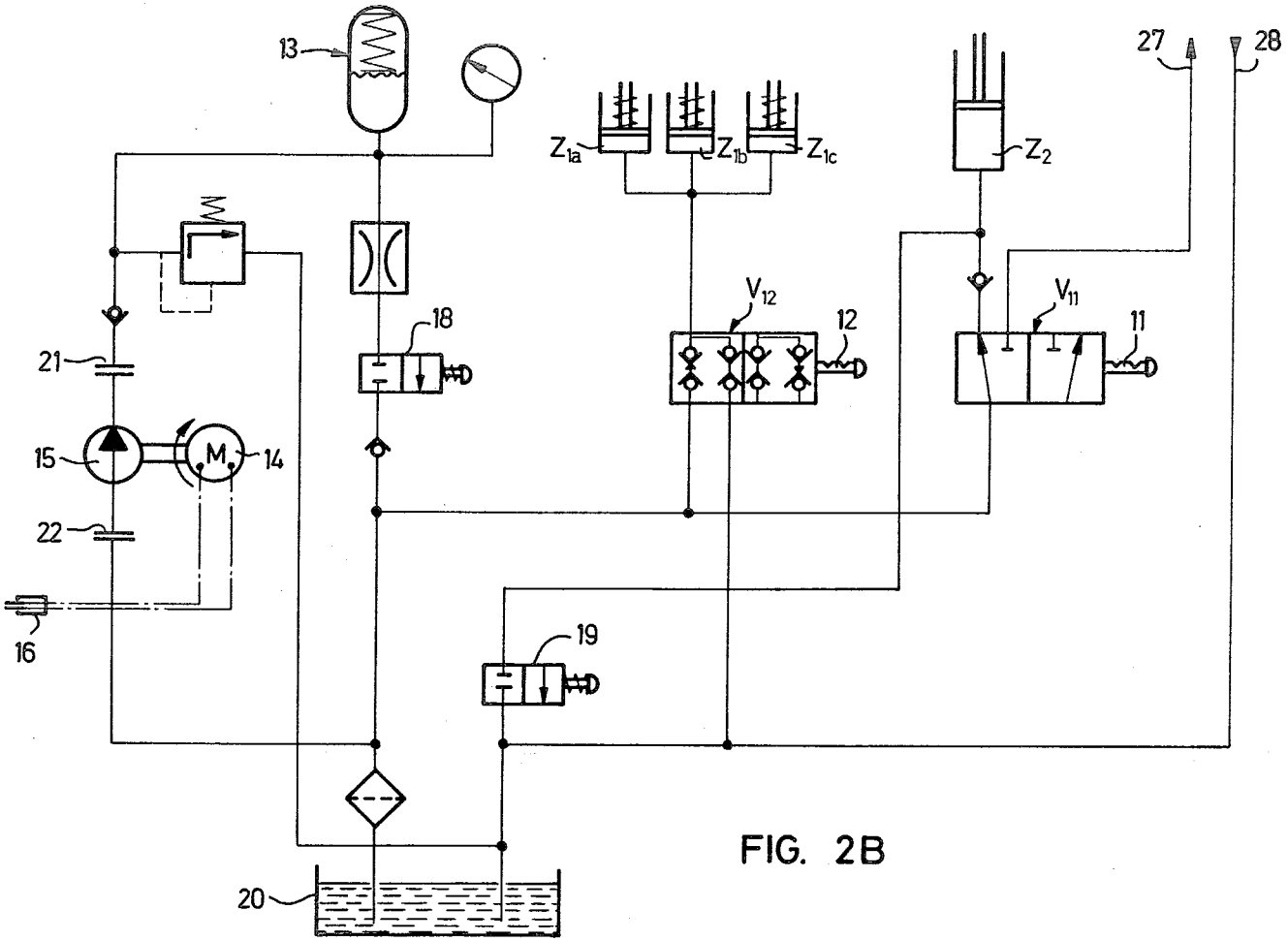

FIGS. 2A and 2B together are a diagram of the hydraulic system.

The operating table illustrated in FIG. 1 comprises a foot 1 which, viewed from above, is T-shaped and has, near each of its three ends, a small wheel or roller 2 disposed within a housing 3 which can be raised or lowered via a lever 4 by a hydraulic working cylinder $Z_{la}$, $Z_{lb}$, $Z_{lc}$ respectively, so that either foot 1 itself or else the three rollers 2 rest on the floor.

Mounted in a foot portion la is a telescopically extensible supporting column 5, a hydraulic working cylinder $Z_2$ being provided for raising and lowering thereof.

On the top of column 5, a saddle-piece 7*a* forming part of a supporting frame 7 is mounted by means of a yoke 6 for pivotal adjustment by hydraulic working cylinders $Z_3$ and $Z_4$ about a transverse axis and a longitudinal axis, respectively.

Lateral support members 8 are pivotally adjustable on frame 7 by hydraulic working cylinders $Z_5$ and $Z_6$ about a transverse axis 9.

Attached to frame 7 is a control panel 10 containing control valve units $V_{11}$, $V_{11a}$, $V_{11b}$, $V_{11c}$ (FIG. 2) which can be operated by hand-levers 11, 11a, 11b and 11c for controlling the supply and withdrawal of pressure oil to and from working cylinders $Z_2$, $Z_3$, $Z_4$ and $Z_5$, $Z_6$ respectively. Built into foot 1 is a control valve unit $V_{12}$ (not shown in FIG. 1) which can be operated by a pedal 12 for controlling the flow of pressure oil to and from working cylinders $Z_{1a}$, $Z_{1b}$, and $Z_{1c}$.

As a source of pressure fluid for all of the working cylinders, a pressure tank or fluid reservoir 13 of a known design is built into foot 1; in addition, a recipient 20 (FIG. 2) is built into foot 1 for receiving flowing out of any of the working cylinders during operation thereof, through the associated valve unit, as is customary in hydraulic systems of this kind.

In the embodiment illustrated, there is also built into foot 1 a charging unit, consisting of an electric of compressed-air motor 14 and a charging pump 15 driven thereby, for reservoir 13; the charging unit can be operated only during periods of non-use of the operating table. Foot 1 is furthermore equipped with a coupling part 16 for connecting an electric supply cable or compressed-air supply hose A, as the case may be, for feeding motor 14.

FIGS. 2A/2B is a diagram of the hydraulic system, FIG. 2A illustrating the parts accommodated in the top part of the operating table and FIG. 2B the parts accommodated in foot 1.

As may easily be seen from FIG. 2B, in order to lower rollers 2, i.e., in order to admit fluid to cylinders $Z_{1a}$, $Z_{1b}$, $Z_{1c}$, a safety valve 18 associated with valve unit $V_{12}$ must be operated together with the latter against spring pressure; to retract rollers 2, valve unit $V_{12}$ need merely be returned to the position shown.

In order to raise supporting column 5 i.e., in order to admit pressure fluid to cylinder $Z_2$, valve 18 must be operated against spring pressure; the pressure fluid then flows into cylinder $Z_2$ through control valve unit $V_{11}$, the latter being in the position shown in the drawing; to lower column 5, it is only necessary to operate a valve 19 against spring pressure.

The shifting of valve unit $V_{11}$ into its other position, i.e., the position not shown, is a necessary preparatory step to operating any one of cylinders $Z_3$ to $Z_6$. In order to operate any of these cylinders or pairs of cylinders, the associated valve unit $V_{11a}$, $V_{11b}$ or $V_{11c}$ must be shifted form the illustrated resting position in one direction or the other and, in addition, valve 18 held in operating position for as long as the particular cylinder is supposed to operate.

Connected in before the pair of cylinders $Z_5$, $Z_6$ is an equalizing cylinder and piston unit 23 which functions in the usual manner; also associated therewith are overflow valve units 24, 25 and a surge tank 26; reference numbers 27 and 28 designate connecting lines.

Thanks to pressure-oil reservoir 13 (of appropriate capacity), the operating table has an autonomous supply of pressure oil which suffices for several hundred strokes of the hydraulic working cylinders (in one embodiment, for example, 240 strokes), hence for all of the working cylinder functions which might have to be performed during a complicated operation.

When the operating table is not in use, motor 14 can be connected, either in the operating room itself or in an anteroom, to a compressed-air or electrical network via air hose or cable A which will be attached to coupling part 16 in order to refill the pressure fluid chamber of reservoir 13 with pressure fluid taken from recipient 20 via a suction line.

The operating table is and remains free of electrical equipment of any kind (which might give to creeping currents when the table is in use) and also of any external hoses, e.g., supply or drain hoses for pressure oil or compressed air, over which a member of the operating team might otherwise stumble. Nevertheless, the operating table can always be moved to the most favorable position in the operating room—even during an operation—in order to provide easy access to the many stationary pieces of equipment and apparatus set up in the operating room, and also to allow the various members of the operating team, who are often numerous, to stand in the most favorable positions.

In another possible embodiment, the charging unit consisting of motor 14 and pump 15 may be installed on a sliding carriage separate from the operating table rather than in foot 1. Coupling part 16 would then be replaced by two hose-coupling parts 21 and 22 (FIG. 2) for connecting pump 15 to pressure fluid reservoir 13 and to the suction line from recipient 20, respectively.

What is claimed is:

1. In an operating table for medical purposes, of the type having a plurality of mutually adjustable table parts including a foot and a plurality of rollers accommodated in said foot, a plurality of hydraulic working cylinders for adjusting said table parts with respect to one another, and control means for controlling said cylinders, said rollers being lowerable to enable displacement of said table, the improvement comprising:

a pressure tank connected to said working cylinders under control of said control means for providing a self-contained pressure fluid source when said operating table is in use, said pressure tank having a capacity for operating said working cylinders through, in the order of, several hundred strokes, a charging unit accommodated in said foot including an electrically operated motor, and a pump driven by the motor for charging said pressure tank, and means for coupling said charging unit to an electrical supply cable, said charging unit being designed to operate only when said operating table is not in use.

2. In an operating table for medical purposes, of the type having a plurality of mutually adjustable table parts including a foot and a plurality of rollers accommodated in said foot, a plurality of hydraulic working cylinders for adjusting said table parts with respect to one another, and control means for controlling said cylinders, said rollers being lowerable to enable displacement of said table, the improvement comprising:

a pressure tank connected to said working cylinders under control of said control means for providing a self-contained pressure fluid source when said operating table is in use, said pressure tank having a capacity for operating said working cylinders through, in the order of, several hundred strokes, a charging unit accommodated in said foot including a pneumatically operated motor, and a pump driven by the motor for charging said pressure tank, and means for coupling said charging unit to a pneumatic supply hose, said charging unit being designed to operate only when said operating table is not in use.

* * * * *